US006973866B2

(12) United States Patent
Lee

(10) Patent No.: US 6,973,866 B2
(45) Date of Patent: Dec. 13, 2005

(54) HYDRAULIC CIRCUIT FOR OPTION TOOL OF HEAVY EQUIPMENT

(75) Inventor: Jae Hoon Lee, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 50 days.

(21) Appl. No.: 10/716,033

(22) Filed: Nov. 18, 2003

(65) Prior Publication Data

US 2004/0261406 A1 Dec. 30, 2004

(30) Foreign Application Priority Data

Jun. 25, 2003 (KR) ..... 10-2003-0041364

(51) Int. Cl.[7] ..... F15B 13/04

(52) U.S. Cl. ..... 91/445; 91/448

(58) Field of Search ..... 91/445, 448, 461; 60/399, 403

(56) References Cited

U.S. PATENT DOCUMENTS 5,469,703 A * 11/1995 Ericsson et al. ..... 60/399
6,745,564 B2 * 6/2004 Koo ..... 91/461

FOREIGN PATENT DOCUMENTS

| | | |
|---|---|---|
| EP | 0768433 | 4/1997 |
| JP | 60 33905 | 2/1985 |
| JP | 60 220893 | 11/1985 |

OTHER PUBLICATIONS

English Abstract of JP 60 220893 dated Nov. 5, 1985.
English Abstract of JP 60 33905 dated Feb. 21, 1985.

* cited by examiner

*Primary Examiner*—Edward K. Look
*Assistant Examiner*—Michael Leslie
(74) *Attorney, Agent, or Firm*—Ladas and Parry LLP

(57) ABSTRACT

In the present invention, it is possible to supply hydraulic fluid by the amount needed in an option tool even when a combined work is performed by engaging an option tool having a different operation pressure to a work apparatus. The hydraulic circuit for an option tool of heavy equipment comprises a poppet valve which is openably and closably installed in a flow path of a supply side of the option tool spool, a first spool which is installed in a flow path between the poppet valve and the option tool spool and has an opening portion adapted to maintain a constant pressure difference when the first spool is switched by pilot pressure discharged from the pilot pump, and a second spool which is installed in a down stream side of the poppet valve and is switched when an over load occurs due to an over pressure exceeding the degree set in the option tool for thereby closing the poppet valve.

14 Claims, 5 Drawing Sheets

PRIOR ART

HYDRAULIC CIRCUIT FOR OPTION TOOL OF HEAVY EQUIPMENT

BACKGROUND OF THE INVENTION

1. Field of the Invention

The present invention relates to a hydraulic circuit for an option tool of heavy equipment which is capable of selectively engaging an option tool (referred to breaker, share, etc.) to a work apparatus such as a boom, etc., and in particular to a hydraulic circuit for an option tool of heavy equipment implemented in such a manner that hydraulic fluid is efficiently supplied by a necessarily set amount during a combined work in which a work apparatus and an option tool are concurrently operated by engaging an option tool having different operation pressures at an end portion of a work apparatus.

2. Description of the Background Art

Generally, in a construction heavy equipment such as an excavator, etc., a breaker having a relatively lower operation pressure or an option tool such as a share, etc. having a relatively higher operation pressure is selectively engaged by disassembling a bucket in order to maximize a work condition or work efficiency. Here, a work apparatus spool or option tool spool is installed in a main control valve in order to control hydraulic fluid supplied to a work apparatus such as a bucket or an option tool.

Among the terminologies used herein, the terminology "Negative system" represents a method for decreasing a discharge amount of a variable displacement hydraulic pump in the case that pilot pressure discharged from an upper stream of a pilot signal generation unit installed in a down stream of a center bypass path is high and increasing a discharge amount of a hydraulic pump in the case that the pilot signal pressure is low.

In addition, the terminology "Positive system" represents a method for increasing a discharge amount of a variable displacement hydraulic pump in the case that pilot pressure applied to a directional switching valve adapted to control hydraulic fluid supplied to a hydraulic cylinder is high and decreasing a discharge amount of a hydraulic pump in the case that pilot pressure is low.

As shown in FIG. 1, a hydraulic circuit for an option tool of heavy equipment in a conventional art includes a variable displacement hydraulic pump 2 and a pilot pump 3 which are connected with an engine 1 and are driven, a work apparatus (not shown) and an option tool 4 which are connected with the variable displacement hydraulic pump 2 and are driven when hydraulic fluid is supplied, a main control valve 6 which is installed in a flow path between the hydraulic pump 2 and the work apparatus, and the hydraulic pump 2 and the option tool 4 and is formed of an option tool spool 5 and a work apparatus spool for controlling a start, stop and direction change of the work apparatus and option tool 4, and a first electromagnetic proportion valve 8 which is installed in a flow path between the pilot pump 3 and the hydraulic pump 2 and outputs a secondary pressure corresponding to an electric signal from a controller 7 for thereby variably controlling a discharge amount of the hydraulic pump 2.

In the drawings, reference numeral 9 represents a remote control valve (RCV) adapted to control pilot pressure switching a corresponding spool of the main control valve 6. 10 represents an option flow amount adjusting apparatus for inputting a signal into a controller 7, wherein the signal corresponds to a set flow amount needed in the option tool 4 for controlling hydraulic fluid supplied to the option tool.

Therefore, when a breaker having a relatively lower operation pressure or a share having a relatively higher operation pressure than that of a breaker and operating under a high pressure work condition is engaged to a work apparatus as an option tool 4, pilot pressure from the pilot pump 3 is applied to the option tool spool 5 based on an operation of the remote control valve 9. As shown in FIG. 1, the pilot signal pressure is switched in a left or right direction and passes through the option tool spool 5, so that an operation pressure from the variable hydraulic pump 2 is switched. The pilot signal pressure is supplied to the option tool 4 for thereby performing a desired work.

A certain signal corresponding to the set flow amount is inputted into the controller 7 through an additionally provided option flow amount adjusting apparatus 11, so that a set flow amount needed in the option tool 4 is supplied. A certain current value corresponding to an input signal is inputted into a first electromagnetic proportion valve 8 in accordance with a control of the controller 7.

As shown in FIG. 3, in the above first electromagnetic proportion valve 8, a signal pressure (referred to a secondary pressure passing through the port A) from the pilot pump 3 to correspond to the current value is outputted to a discharge amount controller of the variable displacement hydraulic pump 2, so that the maximum discharge amount of the hydraulic pump 2 is limited. Therefore, it is possible to discharge a desired amount of hydraulic fluid needed in the option tool 4.

However, in the conventional option tool hydraulic circuit, in the case that a combined work is performed in such a manner that the option tool is operated concurrently with a boom, arm, rotation device, etc., the maximum discharge amount of the variable displacement hydraulic pump 2 is limited (referred to a negative flow amount control method indicated by the curve "a" in FIG. 2). In this case, an operation speed of the work apparatus is decreased, and a combined operation is not properly performed. Therefore, workability is decreased. The work apparatus or option toll 4 may not properly operate, so that a safety accident may occur. There may be a big problem in the safety.

In the case that a hydraulic system which is designed to discharge a maximum flow from the variable displacement hydraulic pump 2 (referred to a positive flow amount control method indicated by the curve "b"), when a work apparatus such as a rotation apparatus, etc. and an option tool 4 are concurrently operated, a certain flow amount of hydraulic fluid is supplied more than the set flow amount needed in the option tool 4 due to a load pressure difference between the option tool 4 and the work apparatus. Therefore, the option tool 4 may be damaged, and durability is decreased. The optical tool may be exchanged.

SUMMARY OF THE INVENTION

Accordingly, it is an object of the present invention to provide a hydraulic circuit for an option tool of heavy equipment which is capable of enhancing workability by obtaining a certain operation speed in such a manner that hydraulic fluid is supplied by the amount needed in an option tool even when a combined work is performed by concurrently operating a work apparatus and option tool by engaging the option tools having different operation pressures to a work apparatus.

It is another object of the present invention to provide a hydraulic circuit for an option tool of heavy equipment which is capable of enhancing a life span by enhancing durability of an option tool in such a manner that it is prevented to provide overflow of amount to an option tool based on a load pressure difference between a work apparatus and an option tool when the work apparatus and option tool are concurrently operated.

To achieve the above objects, in a hydraulic circuit for an option tool of heavy equipment which includes a variable displacement hydraulic pump and a pilot pump which are connected with an engine, a work apparatus and an option tool which are connected with the hydraulic pump and are driven, a main control valve which is installed in a flow path between the hydraulic pump and the work apparatus, and the hydraulic pump and the option tool, a first electromagnetic proportion valve which outputs a second pressure corresponding to an electrical signal applied from a controller and variably controls the discharge amount of the hydraulic pump, and a remote control valve which controls pilot pressure capable of switching a spool of the main control valve, there is provided a hydraulic circuit for an option tool of heavy equipment, comprising a poppet valve which is openably and closably installed in a flow path of a supply side of the option tool spool, a first spool which is installed in a flow path between the poppet valve and the option tool spool and has an opening portion adapted to maintain a constant pressure difference when the first spool is switched by pilot pressure discharged from the pilot pump, and a second spool which is installed in a down stream side of the poppet valve and is switched when an over load occurs due to an over pressure exceeding the degree set in the option tool for thereby closing the poppet valve.

There is further provided a second electromagnetic proportion valve which is installed in a flow path between the pilot pump and the first spool and outputs a secondary pressure corresponding to an electrical signal applied from the controller and switches the first spool.

At least one of the first, second spools and poppet valve is installed inside or outside the main control valve.

The first, second spools and poppet valve are installed inside or outside the main control valve.

There is further provided a third spool which is openably and closable installed in a flow path of a supply side of the option tool spool, and is switched when the second spool is switched due to an over load generated in the option tool, and is adapted to prevent hydraulic fluid from being over supplied by the amount exceeding the amount set in the option tool.

There is further provided an orifice installed in a flow path between the second spool and the poppet valve.

There is further provided an orifice installed in a flow path between the second spool and the third spool.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 4:
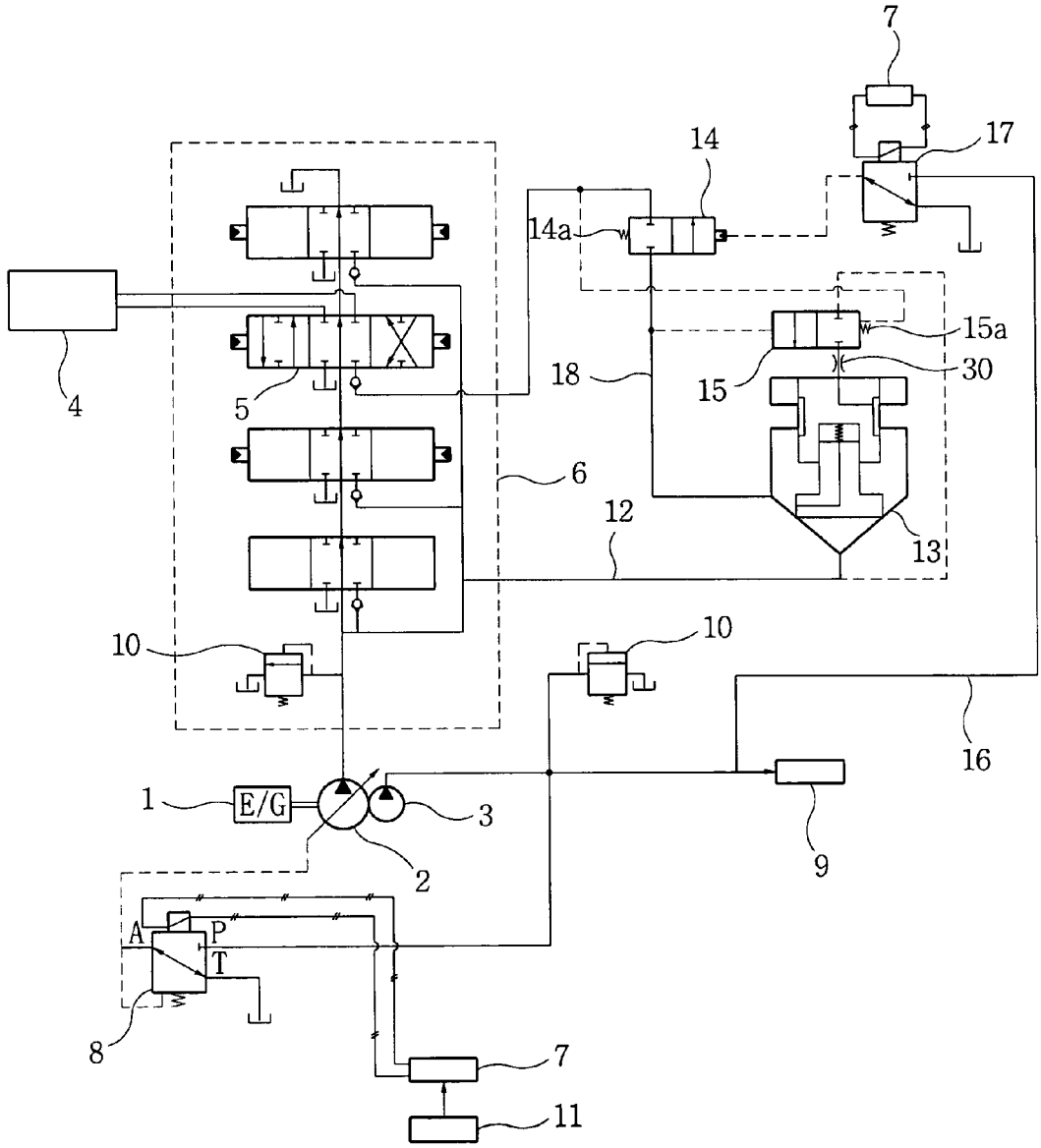
FIG. 4 is a view illustrating a hydraulic circuit for an option tool of heavy equipment according to an embodiment of the present invention.
Figure 5:
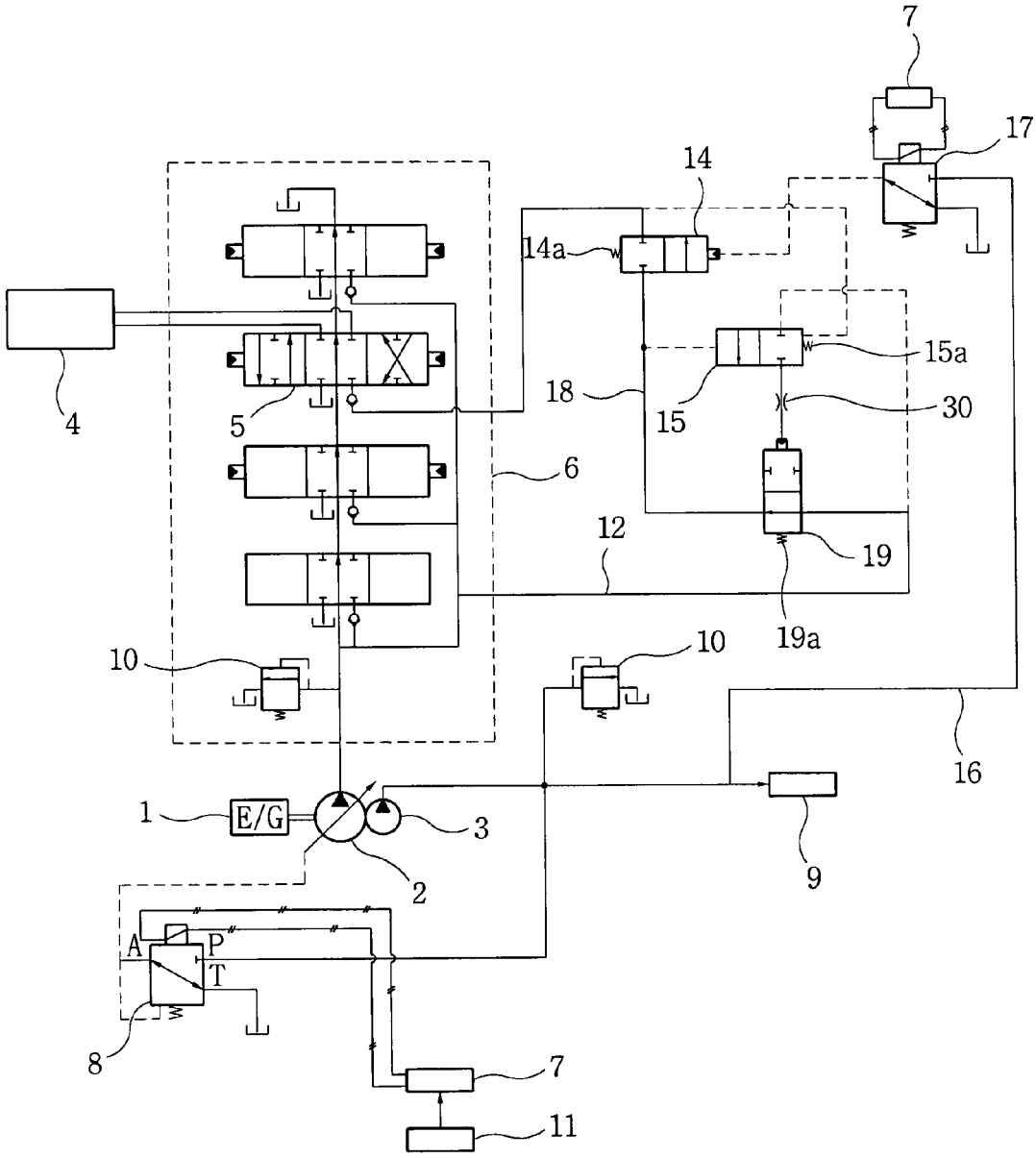
FIG. 5 is a view illustrating a hydraulic circuit for an option tool of heavy equipment according to another embodiment of the present invention.

As shown in FIGS. 4 and 5, there are provided a variable displacement hydraulic pump 2 and a pilot pump 3 which are connected with an engine 1, respectively, a work apparatus (not shown) and an option tool 4 which are connected with the hydraulic pump 2 and are also driven when hydraulic fluid is supplied thereto, a main control valve 6 which is installed in a flow path between the hydraulic pump 2 and the work apparatus and the option tool 4 for controlling a start, stop and direction change of the work apparatus and option tool 4, a first electromagnetic proportion valve 8 adapted to variably control a discharge amount of the hydraulic pump 2 by outputting a secondary pressure corresponding to an electrical signal from a controller 7, and a remote control valve(RCV) 9 adapted to control pilot pressure which switches a spool of the main control valve 6.

Figure 1:
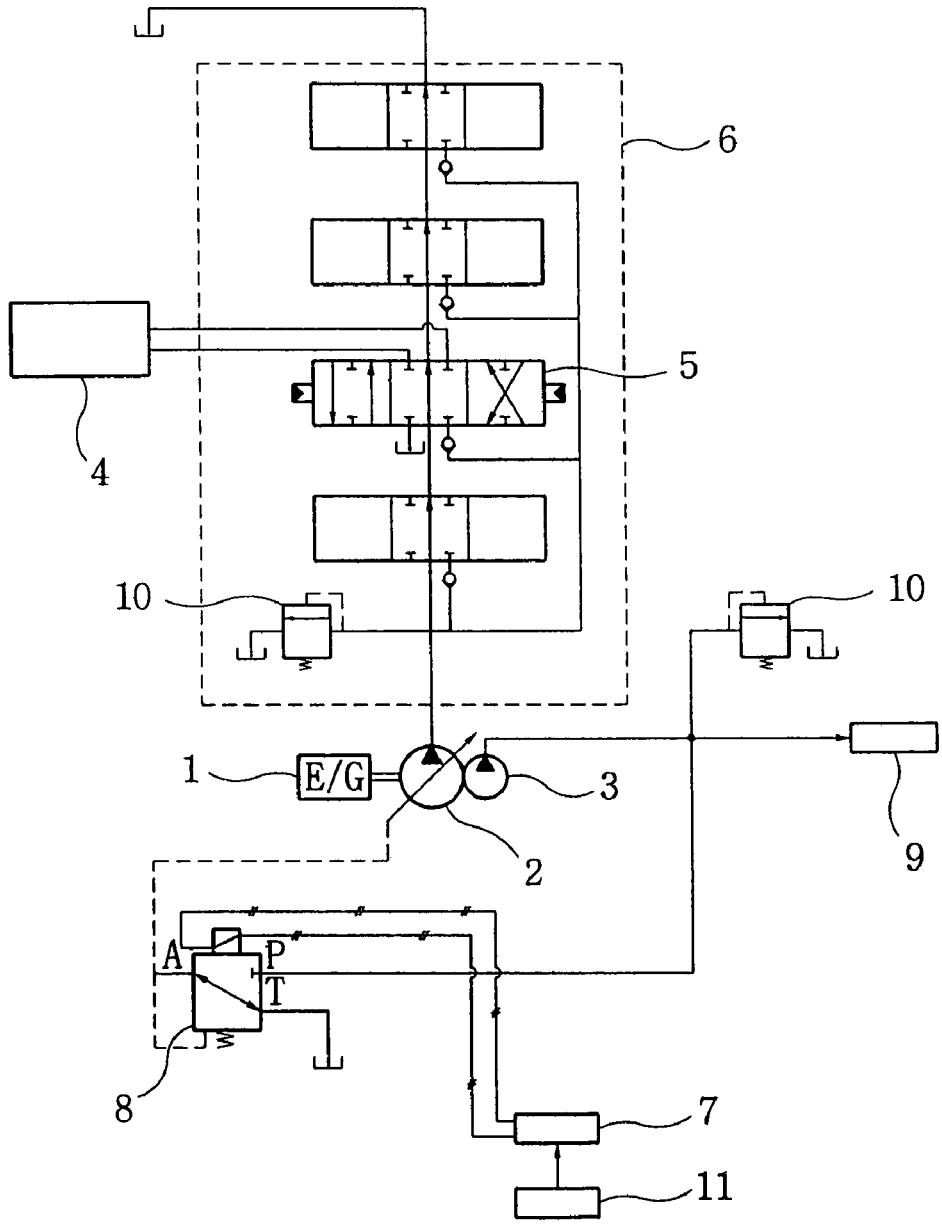
FIG. 1 is a view illustrating a hydraulic circuit for an option tool of heavy equipment in a conventional art.
Figure 2:
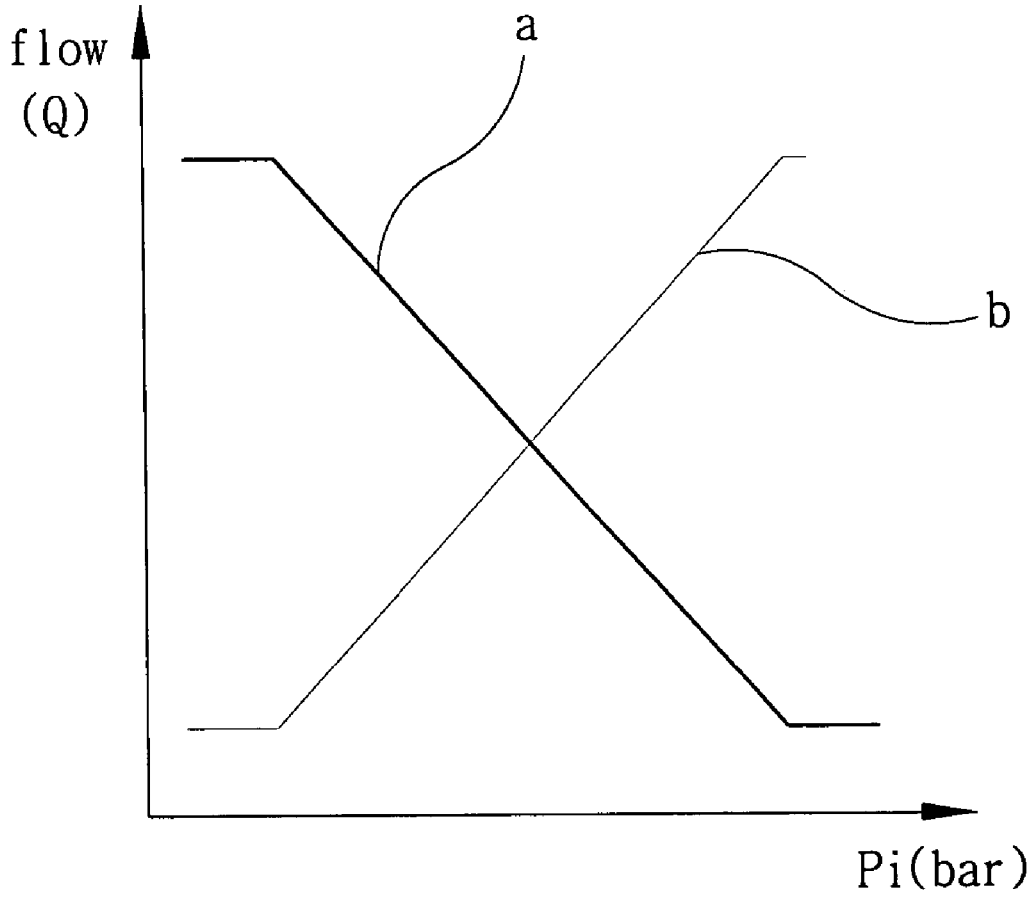
FIG. 2 is a graph of a discharge amount control method of a hydraulic pump.
Figure 3:
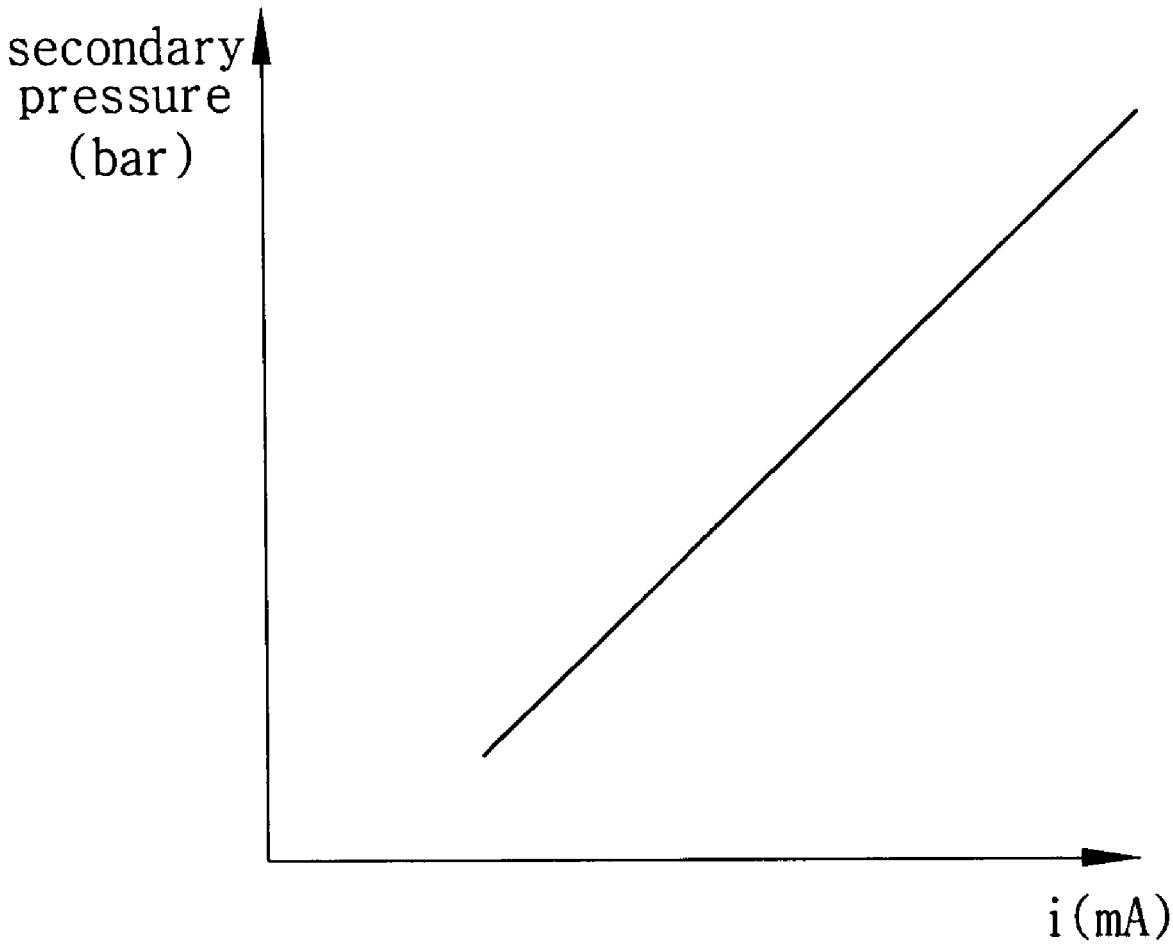
FIG. 3 is a graph illustrating a relationship of a secondary pressure and a current value of an electromagnetic proportion valve.

The above constructions are same as FIG. 1. The same constructions and operation will be omitted. The same constructions will be given the same reference numerals.

As shown in FIG. 4, the hydraulic circuit for an option tool of heavy equipment according to an embodiment of the present invention includes a poppet valve 13 installed in a flow path 12 in a supply side of an option tool spool 5 and opened and closed during an operation. A first spool 14 is installed in a flow path 18 between the poppet valve 13 and the option tool spool 5 and has an opening portion adapted to maintain a certain constant pressure difference during a switching operation as pilot pressure is supplied from the pilot pump 3. A second spool 15 is installed in a down stream side of the poppet valve 13 and blocks the poppet valve so as to protect hydraulic fluid exceeding amount set in the option tool 4 when an overload exceeding a certain pressure set in the option tool 4 occurs. A second electromagnetic proportion valve 17 is installed in a flow path 16 between the pilot pump 3 and the first spool 14 and outputs a second pressure corresponding to an electrical signal from the controller 7 and switches the first spool 14.

At least one of the first and second spools 14 and 15, and the poppet valve 13 may be installed in the interior of the main control valve 6 or may be installed outside the main control valve 6. The first and second spools 14 and 15 and the poppet valve 13 may be installed in the interior of the main control valve 6 or may be installed outside the main control valve 6.

Installing the first and second spools 14 and 15 and the poppet valve 13 inside or outside the main control valve 6 may be simply implemented within the scopes of the present invention, so that the detailed description thereon will be omitted.

In the drawings, reference numeral 10 represents a main relief valve. Reference numeral 11 represents an option flow amount adjusting apparatus adapted to inputting a signal corresponding to the set flow amount into the controller 7 in order for a set flow amount of hydraulic fluid to be supplied to the option tool 4. 14*a*, 15*a* and 19*a* represent a valve spring. 30 represents an orifice.

The operation of the hydraulic circuit for an option tool of heavy equipment according to an embodiment of the present invention will be described with reference to the accompanying drawings.

a) The operation that an option tool is detachably engaged to a work apparatus of heavy equipment and is driven will be described.

As shown in FIG. 4, the second electromagnetic proportion valve 17 outputs a pilot signal pressure from the pilot pump 3 as a secondary pressure corresponding to an electrical signal during an operation of the remote control valve (RCV) 9 in accordance with an electrical signal from the controller 7 and supplies to an opposite side of the valve spring 14*a* of the first spool 14. The internal spool of the first spool 14 is switched in the left direction as shown in the drawings.

Therefore, the hydraulic fluid discharged from the variable displacement hydraulic pump 2 sequentially flows through the poppet valve 13 installed in the flow path 12 of the supply side and the first spool 14 installed in the flow path 18. The hydraulic fluid passes through the option tool spool 5 which is switched in the left or right direction in accordance with pilot pressure from the pilot pump 3 based on an operation of the remote control valve 9 and is supplied to the option tool 4 (referred to breaker, etc.).

Here, the hydraulic fluid discharged from the variable displacement hydraulic pump 2 may be supplied to the breaker, which has a relatively lower operation pressure, by the set amount, and may be supplied to the option tool 4 such as a share, etc, having a relatively higher operation pressure by the set amount.

The controller 7 outputs a current value corresponding to an input signal to the first electromagnetic proportion valve 8 when a certain signal corresponding to the set flow amount of the option tool 4 is inputted into the controller 7 through the option flow amount adjusting apparatus 11. The first electromagnetic proportion valve 8 outputs a secondary pressure corresponding to the current value, so that the maximum discharge amount of the variable displacement hydraulic pump 2 is limited, for thereby discharging the hydraulic fluid by the amount needed in the option tool 4.

b) The combined work that the option tool and work apparatus engaged to the work apparatus of heavy equipment are concurrently operated will be described.

As shown in FIG. 4, when it is intended to perform a combined work by concurrently driving the work apparatus and the option tool 4, a driver inputs a certain electrical signal (referred to the signal corresponding to the maximum discharge amount of the variable displacement hydraulic pump 2) into the first electromagnetic proportion valve 8 from the controller 7. The secondary pressure discharged from the pilot pump 3 and passed through the first electromagnetic proportion valve 8 (referred to the port A) is transferred to the discharge amount controller of the variable displacement hydraulic pump 2, so that the variable displacement hydraulic pump 2 discharge the maximum flow amount.

A part of the hydraulic fluid discharged from the variable displacement hydraulic pump 2 is supplied to a corresponding work apparatus based on a work apparatus spool switching operation of the main control valve 6, and the same time another part of the hydraulic fluid is supplied to the option tool 4 by the set flow amount through the poppet valve 14 installed in the flow path 12 of the supply side, and the first spool 14 installed in the flow path 18. Therefore, it is possible to implement a combined work by concurrently operating the work apparatus and the option tool 4.

In the case that the hydraulic fluid from the variable displacement hydraulic pump 2 is supplied by the amount exceeding the amount set in the option tool 4 due to a load pressure difference which occurs between the work apparatus and the option tool 4, a large pressure difference occurs between the upper stream side and the down stream side of the first spool 14 installed in the flow path 18, so that the second spool 15 is switched in the right direction of FIG. 4. Therefore, a part of the hydraulic fluid of the flow path 12 of the supply side operates as pilot pressure in the down stream side of the poppet valve 13 through the switched second spool 15 for thereby closing the poppet valve 13.

It is possible to prevent the hydraulic fluid discharged from the variable displacement hydraulic pump 2 from being supplied by the amount exceeding the amount set in the option tool 4. The durability of the option tool 4 is enhanced. The life span of the option tool 4 may be extended.

As described above, in the hydraulic circuit for an option tool for heavy equipment according to the present invention, in the case that a combined work is performed by concurrently operating the work apparatus and the option tool 4, the maximum flow amount of hydraulic fluid is discharged from the variable displacement hydraulic pump 2 and is supplied to the work apparatus and the option tool 4 at a certain ratio, respectively, for thereby enhancing the workability.

In addition, in the case that the hydraulic fluid is supplied by the amount exceeding the amount set in the option tool 4 due to a load pressure difference between the work apparatus and the option tool 4, it is possible to supply the hydraulic fluid to the option tool 4 by the set amount in such a manner that the poppet valve 13 which is openably and closably installed in the flow path 12 of the supply side is automatically closed by a high pressure formed in the flow path 12 of the supply side of the option tool 4.

As shown in FIG. 5, in the hydraulic circuit for an option tool for heavy equipment according to another embodiment of the present invention, there is provided a third spool 19. The third spool 19 is openably and closably installed in the flow path 12 of the supply side of the option tool spool 5 and is switched when the second spool 15 is switched when an over load occurs in the option tool 4, for thereby preventing the hydraulic fluid from being supplied to the option tool 4 by the amount exceeding the set amount.

Here, there are provided the option tool 4 which is connected with the variable displacement hydraulic pump 3 and is driven, a main control valve 6 which is installed between the hydraulic pump 3 and the option tool 4 and includes an option tool spool 5 adapted to control the hydraulic fluid, a remote control valve 9 adapted to control pilot pressure capable of switching a corresponding spool of the main control valve 6, and the electromagnetic proportion valve 8 adapted to control the discharge amount of the variable displacement hydraulic pump 3 by outputting a secondary pressure corresponding to an electrical signal from the controller 7. The above constructions are the same as the constructions of FIG. 4. Therefore, the detailed descriptions of the same will be omitted, and the same constructions are given the same reference numerals.

In the above embodiments of the present invention, it is possible to decrease the fabrication cost by simplifying the structure of the hydraulic system. A work time for assembling and connecting the parts of the hydraulic circuit is decreased for thereby enhancing the workability.

The hydraulic circuit for an option tool of heavy equipment according to the present invention has the following advantages.

In the case that a combined work is performed by engaging an option tool having a different hydraulic fluid to a work apparatus and concurrently operating the option tool and the work apparatus, the hydraulic fluid is supplied to the option tool by a necessary amount in such a manner that the maximum discharge amount of hydraulic fluid is discharged from the variable displacement hydraulic pump for thereby enhancing a workability by implementing a desired operation speed. In addition, the durability of the option tool is enhanced by preventing the hydraulic fluid from being supplied by the amount exceeding the amount set in the option tool based on a load pressure difference between the work apparatus and the option tool, and the life span is significantly enhanced.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed:

1. A hydraulic circuit for an option tool of heavy equipment, comprising:

a variable displacement hydraulic pump and a pilot pump which are connected with an engine;

a work apparatus and an option tool which are connected with the hydraulic pump and are driven;

a main control valve which is installed in a flow path between the hydraulic pump and the work apparatus, and the hydraulic pump and the option tool;

a first electromagnetic proportion valve which outputs a second pressure corresponding to an electrical signal applied from a controller and variably controls the discharge amount of the hydraulic pump;

a remote control valve which controls pilot pressure capable of switching a spool of the main control valve;

a poppet valve which is openably and closably installed in a flow path of a supply side of the option tool spool;

a first spool which is installed in a flow path between the poppet valve and the option tool spool and has an opening portion adapted to maintain a constant pressure difference when the first spool is switched by pilot pressure discharged from the pilot pump; and a second spool which is installed in a down stream side of the poppet valve and is switched when an over load occurs due to an over pressure exceeding the degree set in the option tool for thereby closing the poppet valve.

2. The circuit of claim 1, further comprising:

a second electromagnetic proportion valve which is installed in a flow path between the pilot pump and the first spool and outputs a secondary pressure corresponding to an electrical signal applied from the controller and switches the first spool.

3. The circuit of claim 2, wherein at least one of the first and second spools and poppet valve is installed in the interior of the main control valve.

4. The circuit of claim 2, wherein the first and second and poppet valve are installed in the interior of the main control valve.

5. The circuit of claim 2, wherein at least one of the first and second spools and poppet valve is installed outside the main control valve.

6. The circuit of claim 2, wherein the first and second spools and poppet valve are installed outside the main control valve.

7. The circuit of claim 1, wherein at least one of the first and second spools and poppet valve is installed in the interior of the main control valve.

8. The circuit of claim 1, wherein the first and second spools and poppet valve are installed in the interior of the main control valve.

9. The circuit of claim 1, wherein at least one of the first and second spools and poppet valve is installed outside the main control valve.

10. The circuit of claim 1, wherein the first and second spools and poppet valve are installed outside the main control valve.

11. The circuit of claim 1, further comprising:

an orifice installed in a flow path between the second spool and the poppet valve.

12. A hydraulic circuit for an option tool of heavy equipment, comprising:

a variable displacement hydraulic pump and a pilot pump which are connected with an engine;

a work apparatus and an option tool which are connected with the hydraulic pump and are driven;

a main control valve which is installed in a flow path between the hydraulic pump and the work apparatus, and the hydraulic pump and the option tool;

a first electromagnetic proportion valve which outputs a second pressure corresponding to an electrical signal applied from a controller and variably controls the discharge amount of the hydraulic pump;

a remote control valve which controls pilot pressure capable of switching a spool of the main control valve;

a first spool which is installed in a flow path of a supply side of the option tool spool and has an opening portion adapted to maintain a constant pressure difference when the first spool is switched by pilot pressure discharged from the pilot pump;

a second spool which is installed in a down stream side of the flow path of the first spool and is switched when an over load occurs due to an over pressure exceeding the degree set in the option tool for thereby closing the poppet valve; and a third spool which is openably and closably installed in a the flow path of a supply side of the option tool spool, and is switched when the second spool is switched due to an over load generated in the option tool, and is adapted to prevent hydraulic fluid from being over supplied by the amount exceeding the amount set in the option tool.

13. The circuit of claim 12, further comprising:

an orifice installed in a flow path between the second spool and the third spool.

14. A hydraulic circuit for an option tool of heavy equipment, comprising:

a variable displacement hydraulic pump and a pilot pump which are connected with an engine;

a work apparatus and an option tool which are connected with the hydraulic pump and are driven;

a main control valve which is installed in a flow path between the hydraulic pump and the work apparatus, and the hydraulic pump and the option tool;

a first electromagnetic proportion valve which outputs a second pressure corresponding to an electrical signal applied from a controller and variably controls the discharge amount of the hydraulic pump;

a remote control valve which controls pilot pressure capable of switching a spool of the main control valve;

a first spool which is installed in a flow path of a supply side of the option tool spool and has an opening portion adapted to maintain a constant pressure difference when the first spool is switched by pilot pressure discharged from the pilot pump;

a second spool which is installed in a down stream side of the flow path of the first spool and is switched when an over load occurs due to an over pressure exceeding the degree set in the option tool for thereby closing the poppet valve;

a second electromagnetic proportion valve which is installed in a flow path between the pilot pump and the first spool and outputs a secondary pressure corresponding to an electrical signal applied from the controller and switches the first spool; and a third spool which is openably and closably installed in the flow path of a supply side of the option tool spool, and is switched when the second spool is switched due to an over load generated in the option tool, and is adapted to prevent hydraulic fluid from being over supplied by the amount exceeding the amount set in the option tool.

* * * * *